US012345422B2

(12) United States Patent
Rapisarda et al.

(10) Patent No.: US 12,345,422 B2
(45) Date of Patent: Jul. 1, 2025

(54) FAN ASSEMBLY FOR EXTRACTOR HOOD FOR HOBS

(71) Applicant: Faber S.p.A., Fabriano (IT)

(72) Inventors: Andrea Rapisarda, Jesi (IT); Raffaele Galassi, Gubbio (IT)

(73) Assignee: Faber S.p.A., Fabriano (IT)

( * ) Notice: Subject to any disclaimer, the term of this patent is extended or adjusted under 35 U.S.C. 154(b) by 65 days.

(21) Appl. No.: 18/038,097

(22) PCT Filed: Nov. 25, 2021

(86) PCT No.: PCT/EP2021/082979
§ 371 (c)(1),
(2) Date: May 22, 2023

(87) PCT Pub. No.: WO2022/112408
PCT Pub. Date: Jun. 2, 2022

(65) Prior Publication Data

US 2023/0417421 A1 Dec. 28, 2023

(30) Foreign Application Priority Data

Nov. 25, 2020 (IT) ..... 102020000028328

(51) Int. Cl.
*F24C 15/20* (2006.01)
*F04D 17/08* (2006.01)
(Continued)

(52) U.S. Cl.
CPC ..... *F24C 15/20* (2013.01); *F04D 17/08* (2013.01); *F04D 25/06* (2013.01); *F04D 29/4226* (2013.01); *F04D 29/703* (2013.01)

(58) Field of Classification Search
CPC ..... F24C 15/20; F04D 17/08; F04D 17/10; F04D 17/105; F04D 25/06;
(Continued)

(56) References Cited

U.S. PATENT DOCUMENTS 2,994,348 A * 8/1961 Cape ..... B21D 51/24 415/206
4,247,250 A * 1/1981 Lipe ..... F04D 29/42 415/214.1

(Continued)

FOREIGN PATENT DOCUMENTS

CN 104047895 9/2014
CN 207080414 3/2018

(Continued)

OTHER PUBLICATIONS

CN110966257A_MT, Machine Translation of CN110966257 (Year: 2020).*

*Primary Examiner* — Mark A Laurenzi
*Assistant Examiner* — Charles W Nichols
(74) *Attorney, Agent, or Firm* — Volpe Koenig

(57) ABSTRACT

A fan assembly (1) for an extractor hood to be used in a kitchen over a hob includes a body or casing (2) and an impeller (22) driven by an electric motor (20), with the casing having an internal cavity (4) which is bounded by a wall (3) and suitable to contain the impeller and the electric motor. The impeller (22) is located in the cavity (4) in such a manner as to define, with the wall of cavity, a spiral duct (25) for the vapours taken into the cavity, with the duct opening into a terminal outlet (5) and the casing (2) being open (at 8, 9) on opposite sides (6, 7) to favour the entry of vapours at the level of the impeller (22). The wall (3) of the casing includes a plurality of transversal portions having radii or radial configurations which differ from one another.

7 Claims, 12 Drawing Sheets

(51) Int. Cl.
*F04D 25/06* (2006.01)
*F04D 29/42* (2006.01)
*F04D 29/70* (2006.01)

(58) Field of Classification Search
CPC ..... F04D 25/0606; F04D 25/08; F04D 29/42; F04D 29/4206; F04D 29/4226; F04D 29/424; F04D 29/703; F04D 29/422
See application file for complete search history.

(56) References Cited

U.S. PATENT DOCUMENTS

| | | | | |
|---|---|---|---|---|
| 5,474,422 | A | 12/1995 | Sullivan | |
| 5,768,749 | A * | 6/1998 | Ohi | A01G 20/47 15/328 |
| 2004/0253099 | A1* | 12/2004 | Hancock | F04D 17/02 415/206 |
| 2010/0254826 | A1* | 10/2010 | Streng | F04D 25/06 417/44.1 |
| 2011/0031786 | A1* | 2/2011 | Kurokawa | F04D 17/16 415/212.1 |
| 2013/0071238 | A1* | 3/2013 | Lu | G06F 1/203 415/203 |

FOREIGN PATENT DOCUMENTS

| | | | |
|---|---|---|---|
| CN | 110966257 | A * | 4/2020 |
| CN | 110996257 | | 4/2020 |
| EP | 0985829 | | 3/2000 |
| EP | 1156224 | | 11/2001 |

* cited by examiner

FAN ASSEMBLY FOR EXTRACTOR HOOD FOR HOBS

CROSS-REFERENCE TO RELATED APPLICATIONS

This application is a 371 National Phase of International Application No. PCT/EP2021/082979, filed Nov. 25, 2021, which claims priority to Italian Patent Application No. 102020000028328, filed Nov. 25, 2020, both of which are incorporated herein by reference as if fully set forth.

TECHNICAL FIELD

The subject matter of the present invention is a fan assembly for a kitchen extractor hood

BACKGROUND

As is known, the fan assembly is an essential component of a kitchen hood suitable to be located above a hob with the aim of taking in the vapours (containing fumes, fats, oils) which are produced during the preparation of foodstuffs on said hob. Said vapours, after being filtered, are taken in by the fan assembly and directed towards a hood outlet, which may be connected to an environment external to the kitchen or which returns to the kitchen the vapours which have been taken in and filtered.

In this document, "fan assembly" is meant to include the component of the kitchen hood comprising a casing or body containing an impeller and its corresponding electric motor which drives it. Upon said driving, the vapours which are produced on the cooking hob are taken in the casing of the fan assembly and then sent towards the hood exhaust opening.

More particularly, the kitchen hood fan assembly comprises the body or casing having an internal cavity bounded by a wall of the casing and in which is located the impeller and the adjacent electric motor powering it axially. The impeller is located transversely in the casing in such a way as to create, with the wall of the casing, a spiral duct that ends in the hood outlet. Furthermore, the impeller takes in the vapour from opposing openings made in the fan casing, which openings are usually provided with grilles with radial ribs which start from the edge of each opening and end at the level of a central part of the latter where they are connected to an end ring. One of said rings, located on one side of the body, is close to the electric motor and is conventionally attached thereto in such a manner as to support it.

It is of fundamental importance in kitchen hoods to have fans with a high level of containment of the noise generated during the operation thereof. It is also very important to have fans with high fluid-dynamic efficiency in order to reduce consumption (resulting in high energy efficiency) during use of the hood.

It is known to obtain quiet and efficient hoods through appropriate design of their impellers and motors.

EP0985829 describes a fan assembly for an extractor hood to be used in a kitchen comprising a casing having an inner cavity adapted to contain an impeller and an electric motor. The impeller is placed in a casing cavity so as to define, with the wall of the latter, a spiral duct, for the vapours drawn into this cavity, from a cooking hob. The duct opens in an end outlet from which the vapours are expelled after their known filtration.

The casing is open on opposite sides to facilitate the entry of the taken in vapours.

The casing comprises a plurality of sections having radial configurations different from each other.

Fan assembly for kitchen extractor hoods having a casing obtained by assembling a plurality of parts having radial configurations different from each other are also described in CN110966257, EP1156224, CN104047895 and CN207080414.

SUMMARY

The object of the present invention is to provide a fan assembly for an extractor hood which has high fluid-dynamic efficiency and a consequent high energy efficiency without, however, acting on the moving components (impeller and electric motor) of the fan assembly of the hood.

The object of the present invention is accordingly that of providing a fan assembly which has such efficiency features (improved with respect to what can be achieved with known solutions) thanks to its immobile and structural components.

In particular, the object of the invention is that of providing an improved fan assembly having a casing made in such a way as to enable said increases in the fluid-dynamic and energy efficiency of the extractor hood.

A further object of the present invention is that of providing a fan assembly in which the configuration and dimensional characteristics of the casing enable not only said increases in fluid-dynamic and energy efficiency, but also a reduction in the noise generated during operation of the fan itself.

These and other objects, which will be obvious to a person skilled in the art, are achieved by a fan having one or more of the features described herein.

BRIEF DESCRIPTION OF THE DRAWINGS

To enhance understanding of the present invention, the following drawings are appended by way of purely indicative, but non-limiting, illustration, in which.

DETAILED DESCRIPTION

Figure 1:
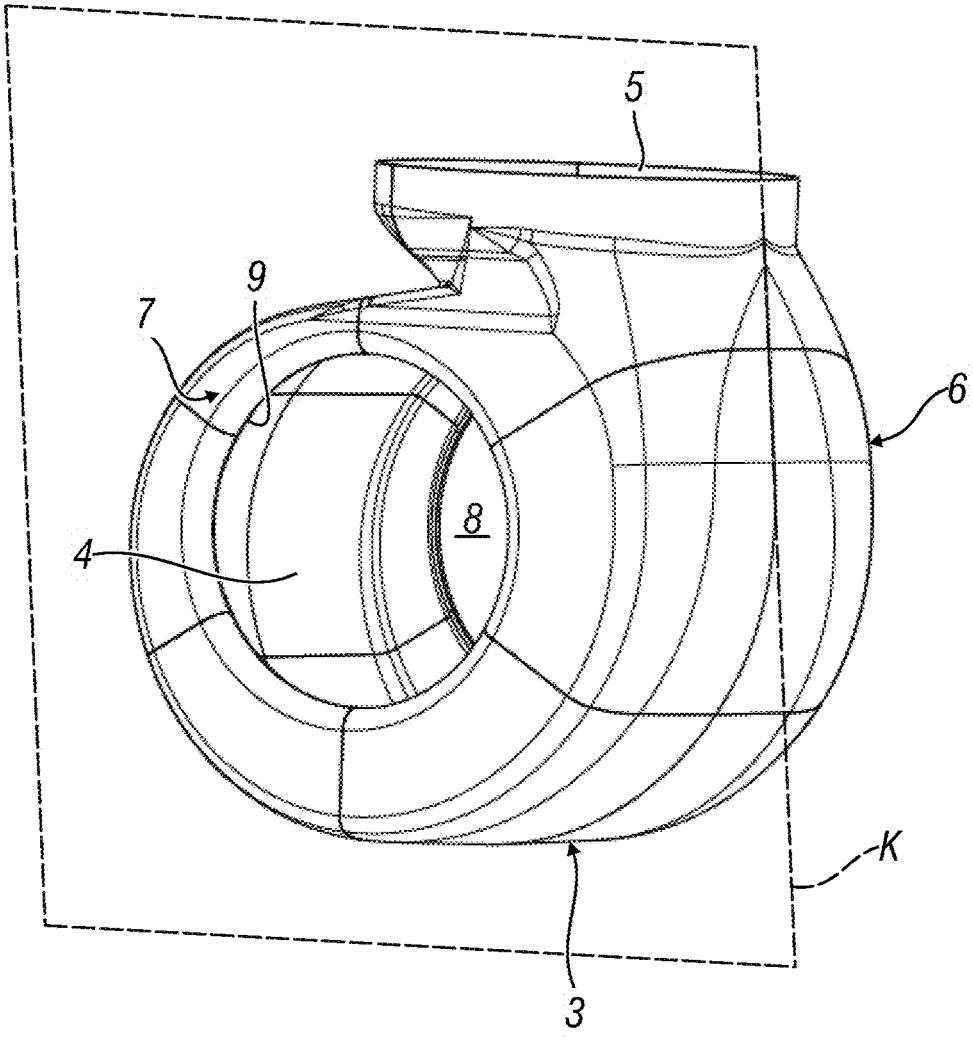
FIG. 1 shows a perspective view from one side of a fan assembly casing according to the invention.
Figure 2:
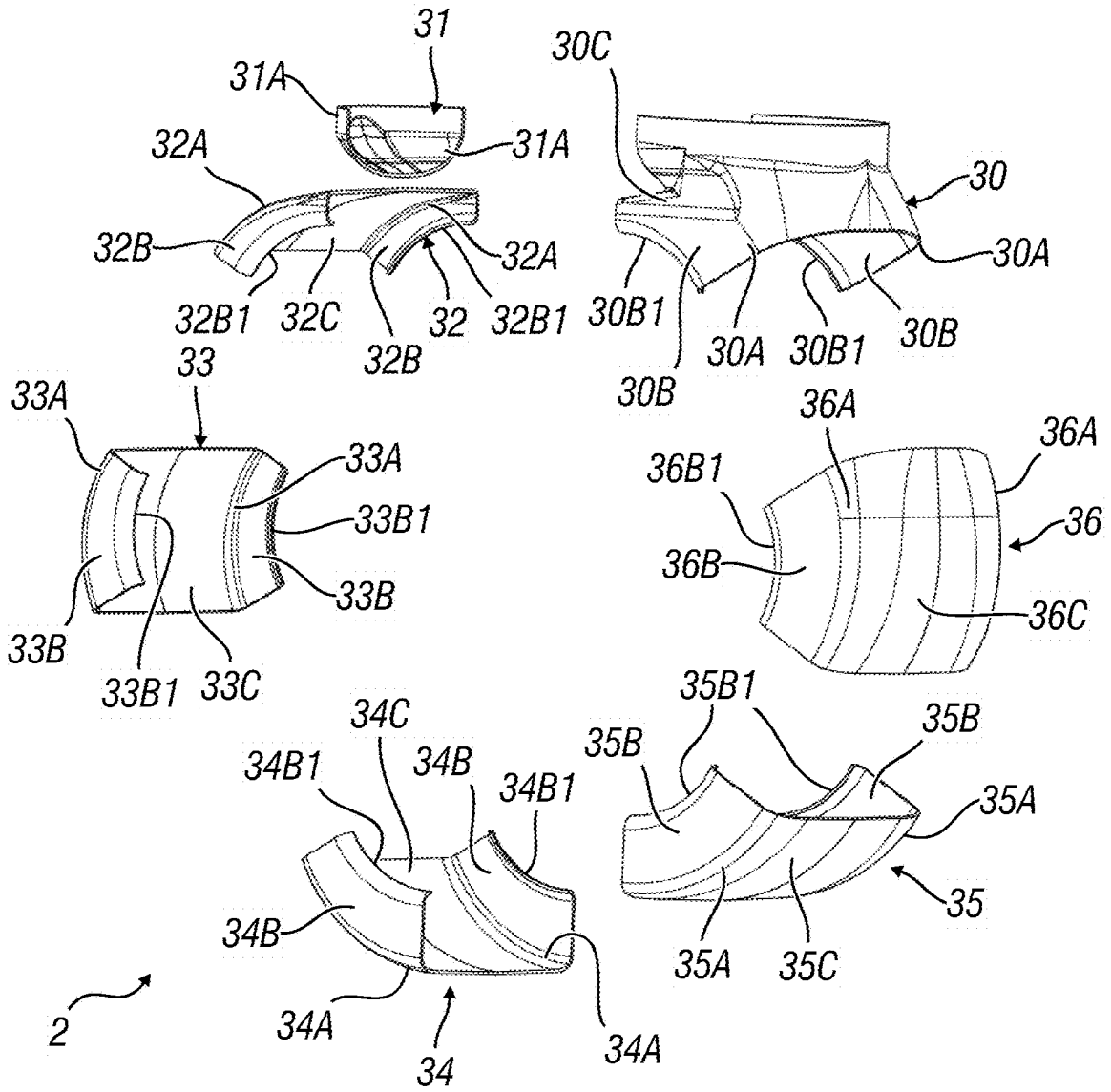
FIG. 2 shows an exploded perspective view of the casing of FIG. 1.
Figure 3:
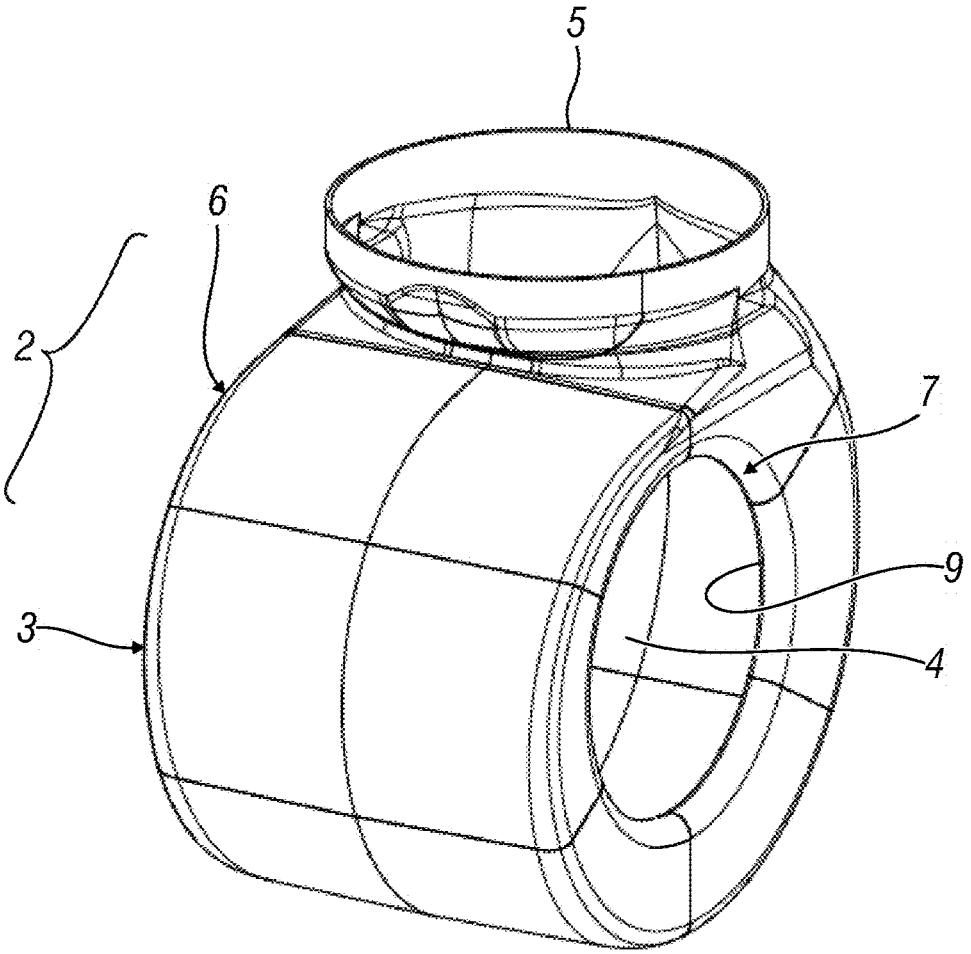
FIG. 3 shows a perspective view of the casing of FIG. 1 from another angle.
Figure 4:
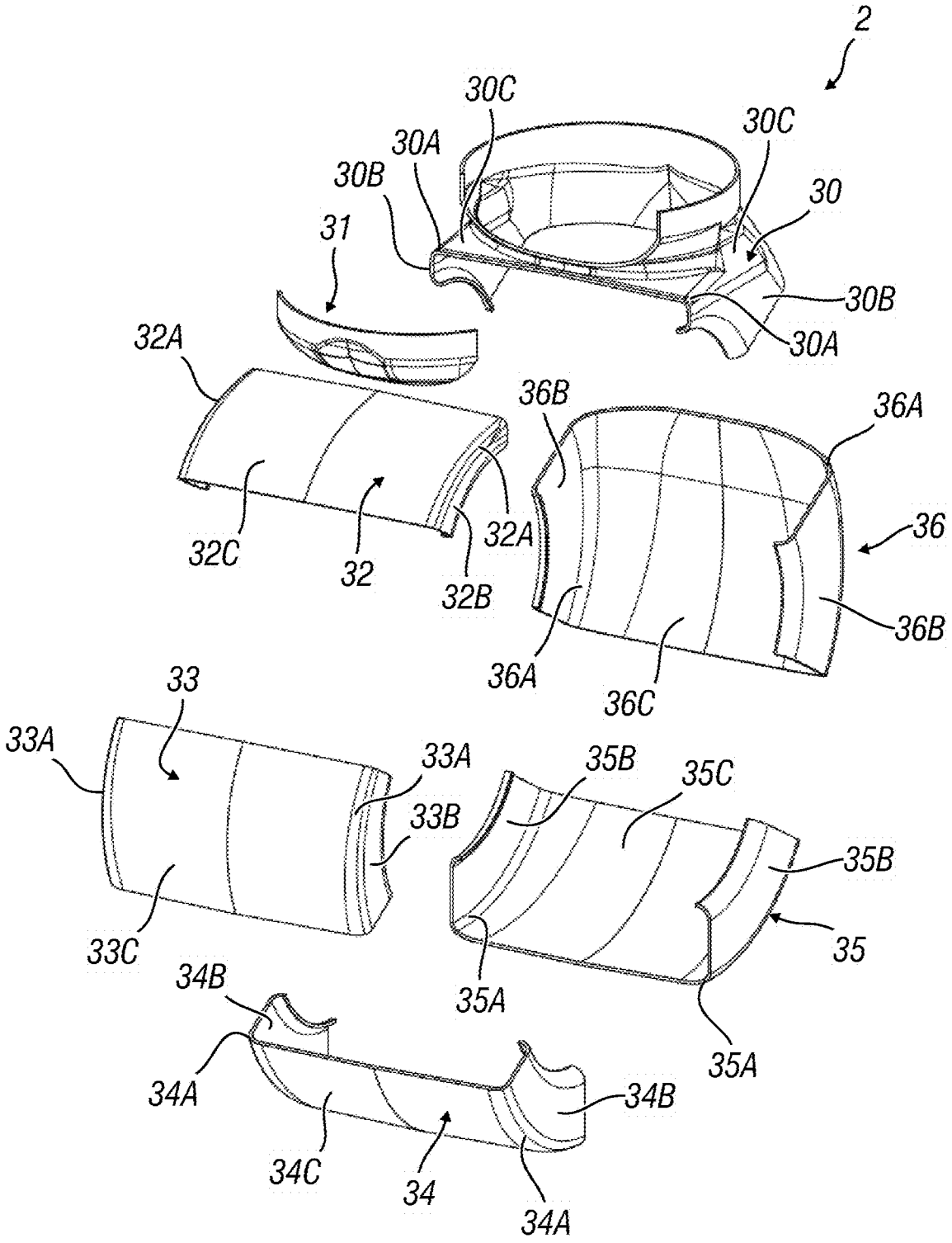
FIG. 4 shows an exploded perspective view of the casing of FIG. 3.

With reference to the above cited figures, a fan assembly 1 comprises a body or casing 2 which bounds, with a wall 3 thereof, a cavity 4 opened at an exhaust opening 5, at the top (with reference to FIGS. 1-3); the cavity is also opened on its opposing sides 6 and 7 where side openings or openings 8 and 9 to take in the vapours are provided (vapour intake or inlet openings). On the side openings 8 and 9 are located grilles 10 and 11 having ribs 12 and 13 respectively which converge towards an end ring 14 and 15 located centrally at the respective side openings 8 and 9.

The casing 2 accommodates an electric motor 20 having an output or drive shaft 21 on which is keyed an impeller 22, both of which are of known type and are not further described. The electric motor 20 is attached by way of connecting members 23, to the end ring 15 of the grille 11.

In known manner, the electric motor 20 and the impeller 22 are located within the casing 2 in such a manner as to define, with the wall 3, a channel 25 having, from a part 40 of the casing 2 denoted "blower cut-off" that will be described later, a spiral shape having a cross-section which gradually increases towards the outlet or exhaust opening 5. Through the latter, vapours generated on a hob, at the level of which there is a hood with the fan assembly 1, are taken in by the side (inlet) openings 8 and 9 and directed into the channel 25 and expelled from the exhaust opening 5.

The casing 2 is defined by a plurality of transverse portions that is portions comprising at least a perimetral edge of each opening 8 and 9, each portion defining a transversal part of the casing wall 3. With "peripheral edge" is meant a portion of the perimeter of each opening as it will be described later.

The above portions may be made independently of one another or be a component of larger parts of the casing.

Starting from the exhaust outlet 5, that is from the blower cut-off portion 40 and moving along the channel 25, said outlet 5 and the portion 40 are parts of a first section 30 of the casing 2, with the exhaust outlet 5 being partly formed by outlet section 31; other consecutive and adjacent sections along the channel 25 are denoted 32, 33, 34, 35, 36. These sections are therefore assembled together in per se known manner to define the casing 2 with its side openings 8 and 9. In the alternative, at least some of the sections may be components of two half-shells, each having a completed side opening (not a portion of it) of the casing and connected together on a plane K perpendicular to the axis W of the drive shaft 21 (see FIG. 1) and then parallel to said openings. In a further alternative, said sections may, in pairs or in a different number, be components of parts of the casing 2 which are then assembled with one another in per se known manner. Said sections of plastics material are independently obtained by moulding; alternatively, they may be made from aluminium or aluminium alloy by die-casting.

Figure 5:
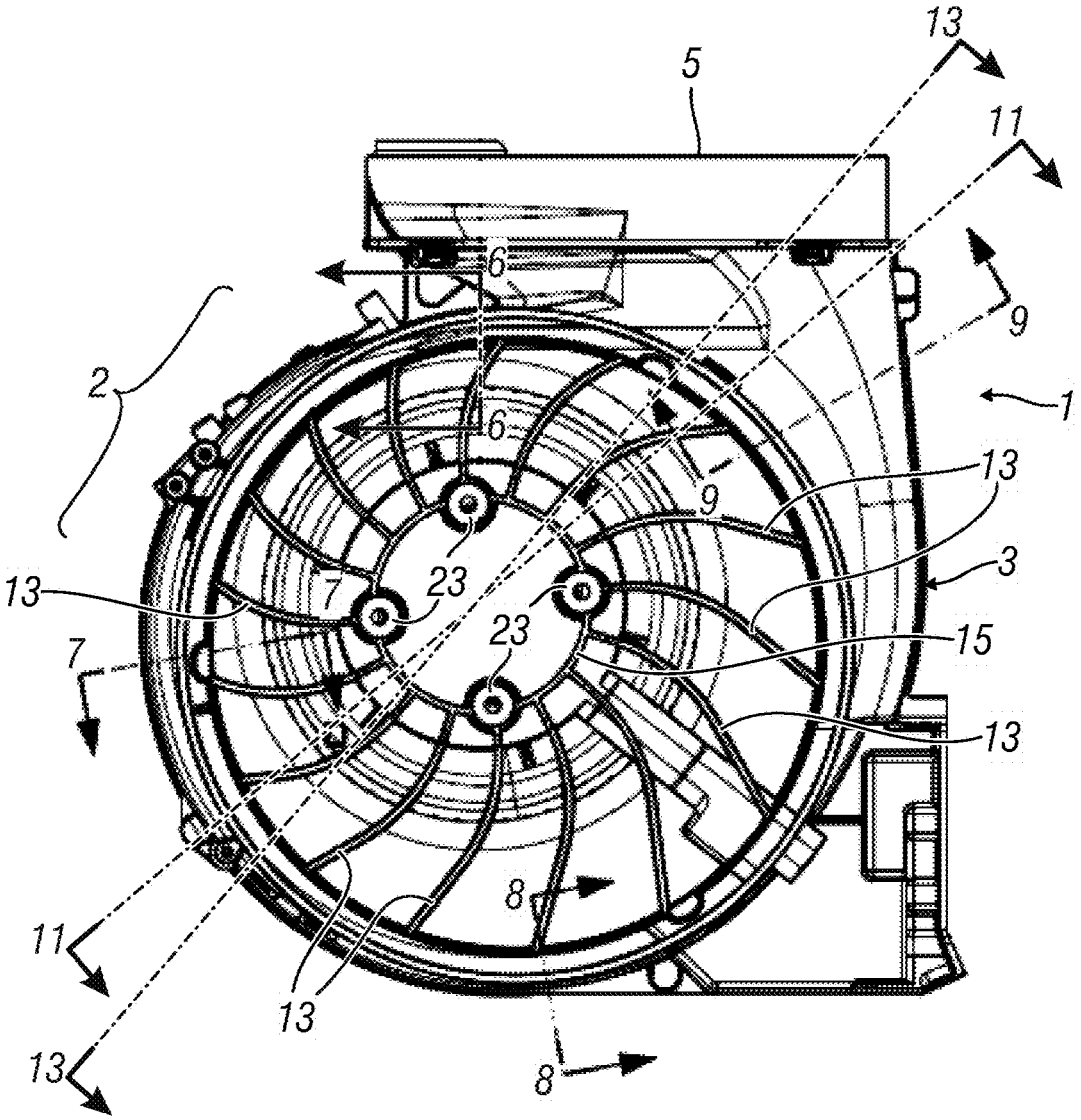
FIG. 5 shows a side view of the fan assembly according to the invention.
Figure 6:
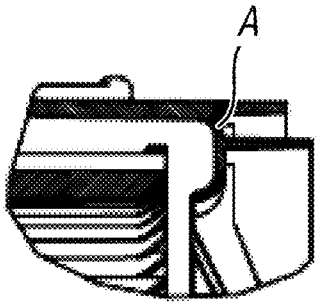
FIG. 6 shows a sectional view along line 6-6 of FIG. 5.
Figure 7:
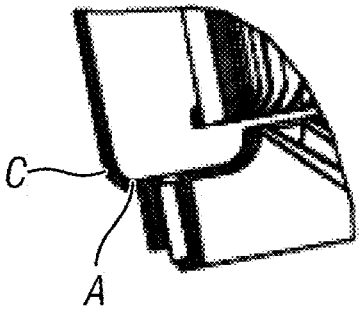
FIG. 7 shows a sectional view along line 7-7 of FIG. 5.
Figure 8:
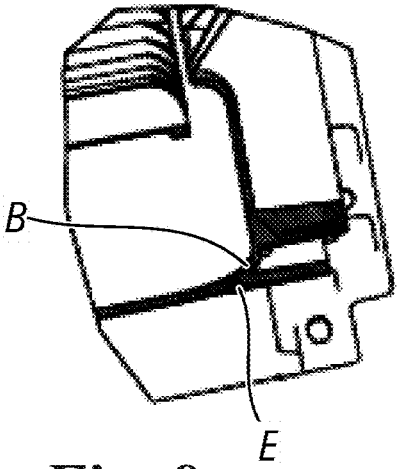
FIG. 8 shows a sectional view along line 8-8 of FIG. 5.
Figure 9:
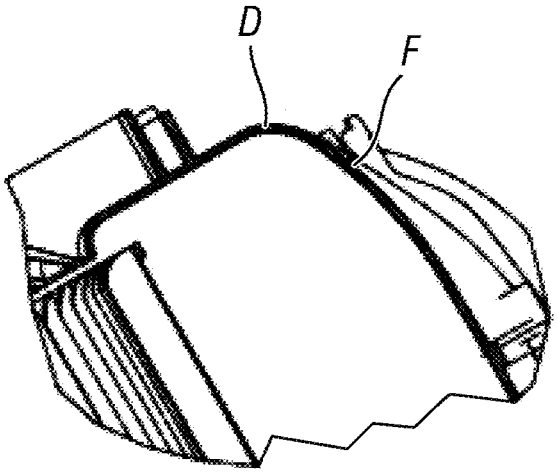
FIG. 9 shows a sectional view along line 9-9 of FIG. 5.

At least some, but preferably all, of said portions, or at least sections 30 and 32-36, have corners 30A, 32A, 33A, 34A, 35A and 36A having different radii of curvature from one another. Said radii of curvature are denoted A, B, C, D, E and F in FIG. 5 and have the following values:

- A between 1 and 5 mm, preferably between 2 and 4 mm and advantageously between 3 and 3.5 mm.
- B between 2 and 8 mm, preferably between 3 and 7 mm and advantageously between 5 and 5.5 mm.
- C between 3 and 12 mm, preferably between 5 and 10 mm and advantageously between 8 and 8.5 mm.
- D between 10 and 30 mm, preferably between 15 and 25 mm and advantageously between 15 and 18 mm.
- E between 20 and 40 mm, preferably between 25 and 35 mm and advantageously between 30 and 32 mm.
- F between 90 and 120 mm, preferably between 95 and 115 mm and advantageously between 100 and 110 mm.

These geometric values of the various radii of curvature of the sections which define the casing 2, namely of the radii which connect the side surfaces 30B, 32B, 33B, 34B, 35B and 36B (whose free edges 3261, 3361, 3461, 3561, 3661 with the free edges 3061 of the side surface 30 define the perimetral edge of openings 8 and 9) and the transverse surfaces 30C, 32C, 33C, 34C, 35C and 36C, allow the casing 2 to follow a spiral course capable of providing optimum fluid-dynamic performance and of reducing the noise emitted by the fan assembly during the operation thereof. Said effect has surprisingly been found to be related precisely to the different configurations of sections 30 and 32-36 of the casing, which configurations are obtainable during production of the casing by methods which have no impact on overall production costs.

It should be noted that the particular configuration of the casing 3 obtained with the sections 30 and 32-36 thereof produced as described above, makes it possible to obtain the spiral channel 25 which may be defined by the mathematical formula (which is specific to the fan assembly and the impeller):

$$r(\Psi)=r_1*(1+K\Psi)$$

in which:

- r(Ψ)=generic distance between the centre of the impeller 22 and the wall 3 of the casing as a function of the angle where it is calculated, said angle being calculated starting from, along a plane of symmetry P of the impeller, from a segment connecting a centre G of the impeller 22 itself with the point of the casing closest to said centre (as will be indicated below); said angle increases in the direction of increase in cross-section of the spiral defined by the channel 25;
- r_1=minimum distance between impeller 22 and wall 3;
- K=constant value for the specific fan assembly and the specific impeller which is calculated on the basis of r_1 and the radius at 270° in the casing (r4), which are values set at the preliminary design phase.
- Ψ=arc unfolding value stated in degrees (or unfolding angle).

Said channel, thus defined, makes it possible to increase (up to values approaching 10%) the dynamic efficiency of the fluid flowing therein and to reduce the noise generated by the fan assembly during use.

Figure 15:
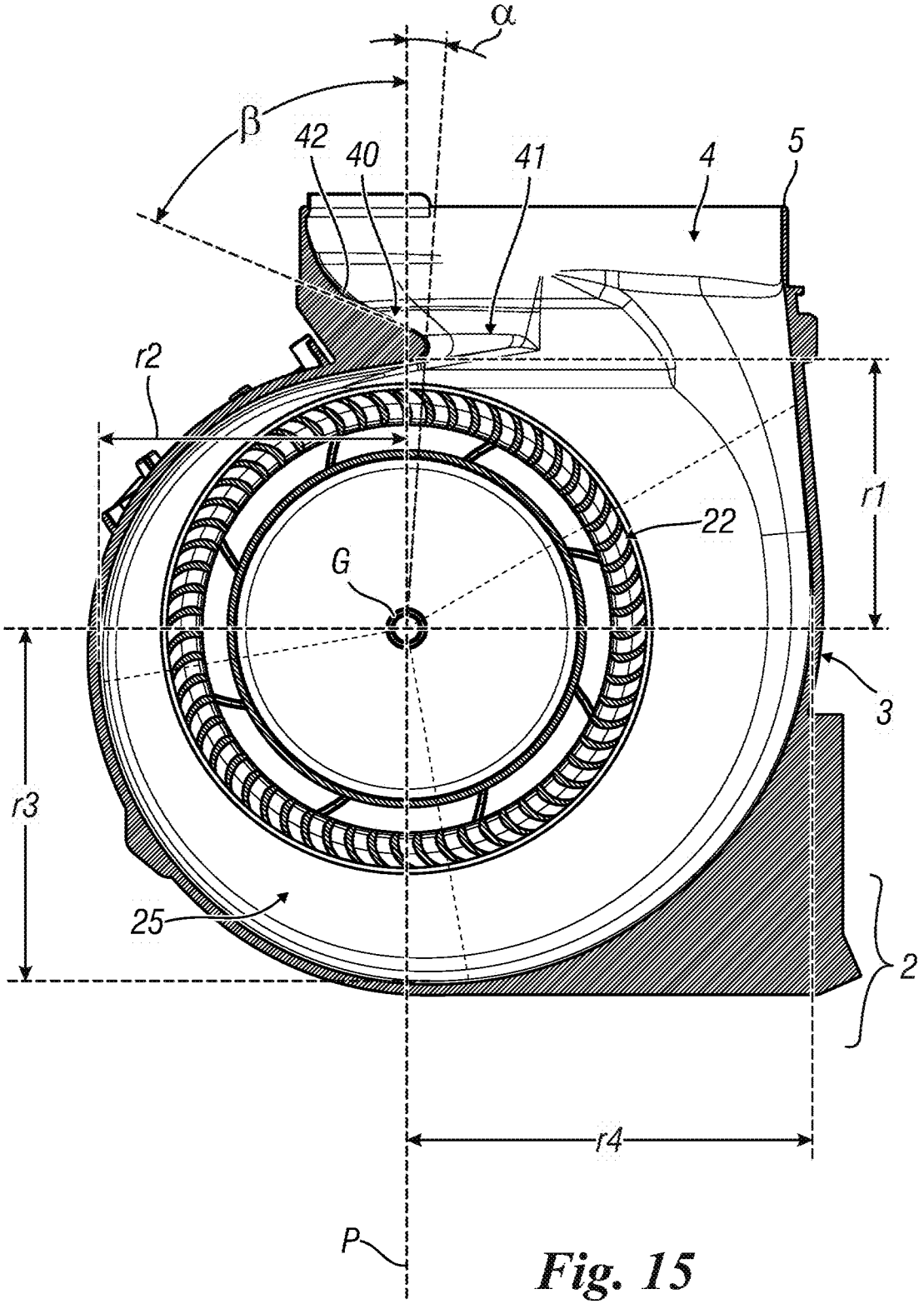
FIG. 15 shows a sectional view along line 15-15 of FIG. 10 of the fan assembly according to the invention with some components removed for greater clarity.

Some of the distances r (substantially at 0°, 90°, 180° and 270° starting from r_1) are indicated in FIG. 15.

Radius r_1 is calculated relative to the above-mentioned segment which connects the centre G of the impeller 22 to the point closest to said centre of the (internal) wall 3 of the casing 2. In particular, said radius r_1 is calculated with respect of the above cited part 40 of the casing 2 (per se known and usually located within the fan assembly of the extractor hoods) denoted "blower cut-off" which, as is known, has an effect on reducing the fluid-dynamic noise of the blower. It has surprisingly been discovered that by extending the central end 41 of said part beyond the plane of longitudinal symmetry P of the impeller (see FIG. 15) within the section 36 close to the exhaust opening or outlet 5, it is possible to reduce such noise by at least up to 10% while also increasing the fluid-dynamic efficiency by a value of greater than 5-6%.

More particularly, the angle α formed between the connecting line (or a connecting segment) connecting said end 41 with the centre G of the impeller 22 is between 3.3° and 5.0°, advantageously between 3.7° and 4.5° and is preferably equal to 4°.

Figure 10:
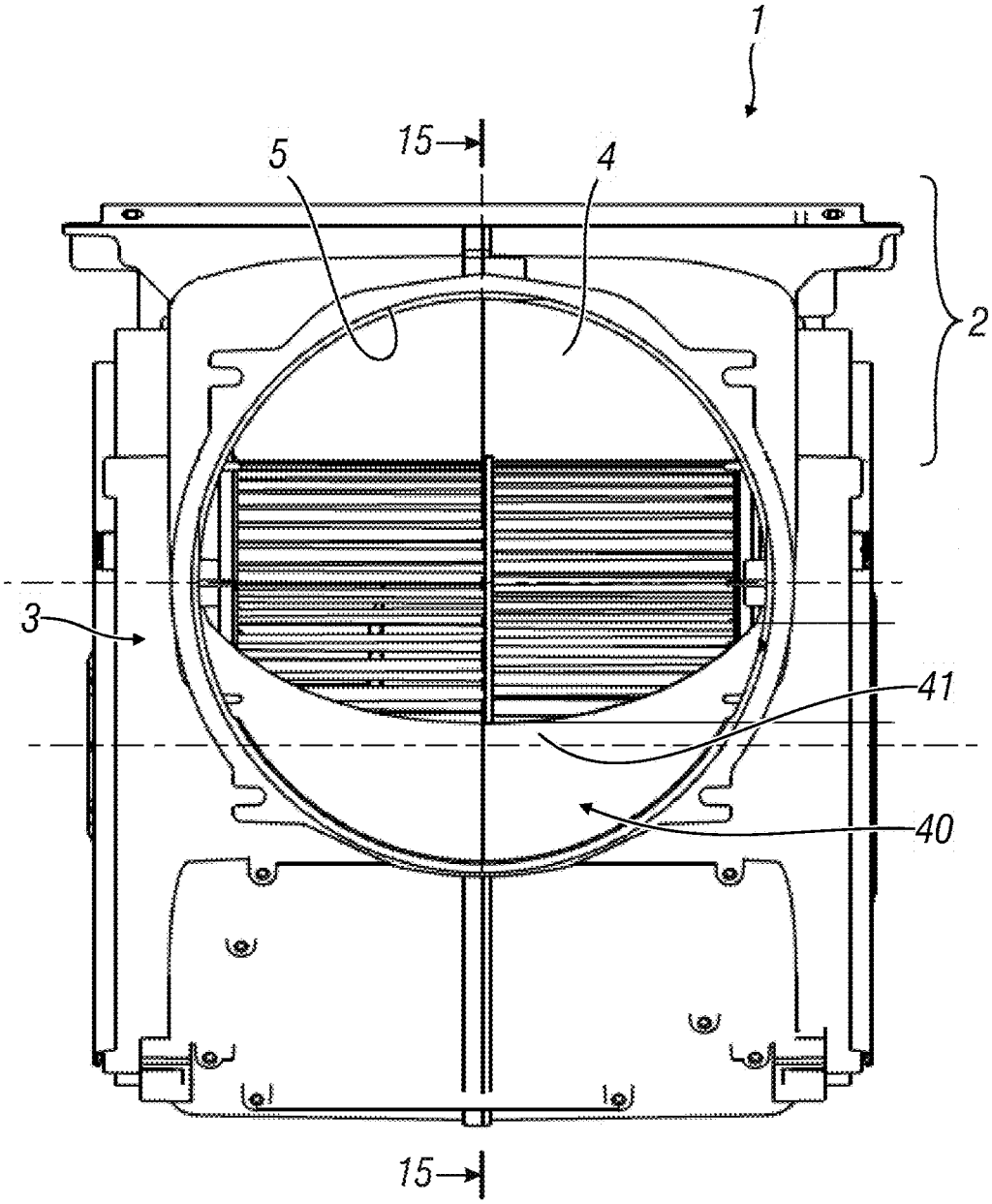
FIG. 10 shows a top view of the fan assembly of FIG. 5.

The part 40 is of an arcuate, half-moon configuration (see FIG. 10), with an inclined upper wall 42 which forms an angle β of between 45° and 70° and preferably of around 60° with the plane P (see FIG. 15).

Further reductions in noise and increases in efficiency have surprisingly been achieved by making the diameter $D_O$ of each inlet opening 8 and 9 and the inner diameter $D_I$ of the impeller 22 identical. Thanks to this characteristic, noise is reduced by almost 1%, while fluid-dynamic efficiency is increased by 3%.

This dimensional characteristic of the openings 8 and 9 is not obtained on the basis of a simple design choice, but on the basis of a careful fluid-dynamic study of the fan assembly that is contrary to normal design methodology which provides inlet openings of a diameter greater than that of the impellers in order to facilitate vapour intake. This study revealed that the air taken in by the openings 8 and 9 and pressurised within the spiral channel 25 of the impeller 22 tends to be drawn back towards the outside of the casing 2 along the extreme edge of the impeller and out over the outer periphery of said openings. Said effect, known as "back-flow" in the field of turbomachinery, has also been found to occur in hood fan assemblies. Thanks to the configuration of the diameters $D_O$ of the openings 8 and 9 and the inner diameter $D_I$ of the impeller 22, said "back-flow" effect is at least appreciably reduced, if not entirely eliminated.

There is also an improvement in the tone of the noise generated by the activation of the motor and the rotation of the impeller thanks to avoiding the propagation outside the casing 2 of the BPF (blade pass frequency) noise associated with the movement of the blades of the impeller 22.

Figure 11:
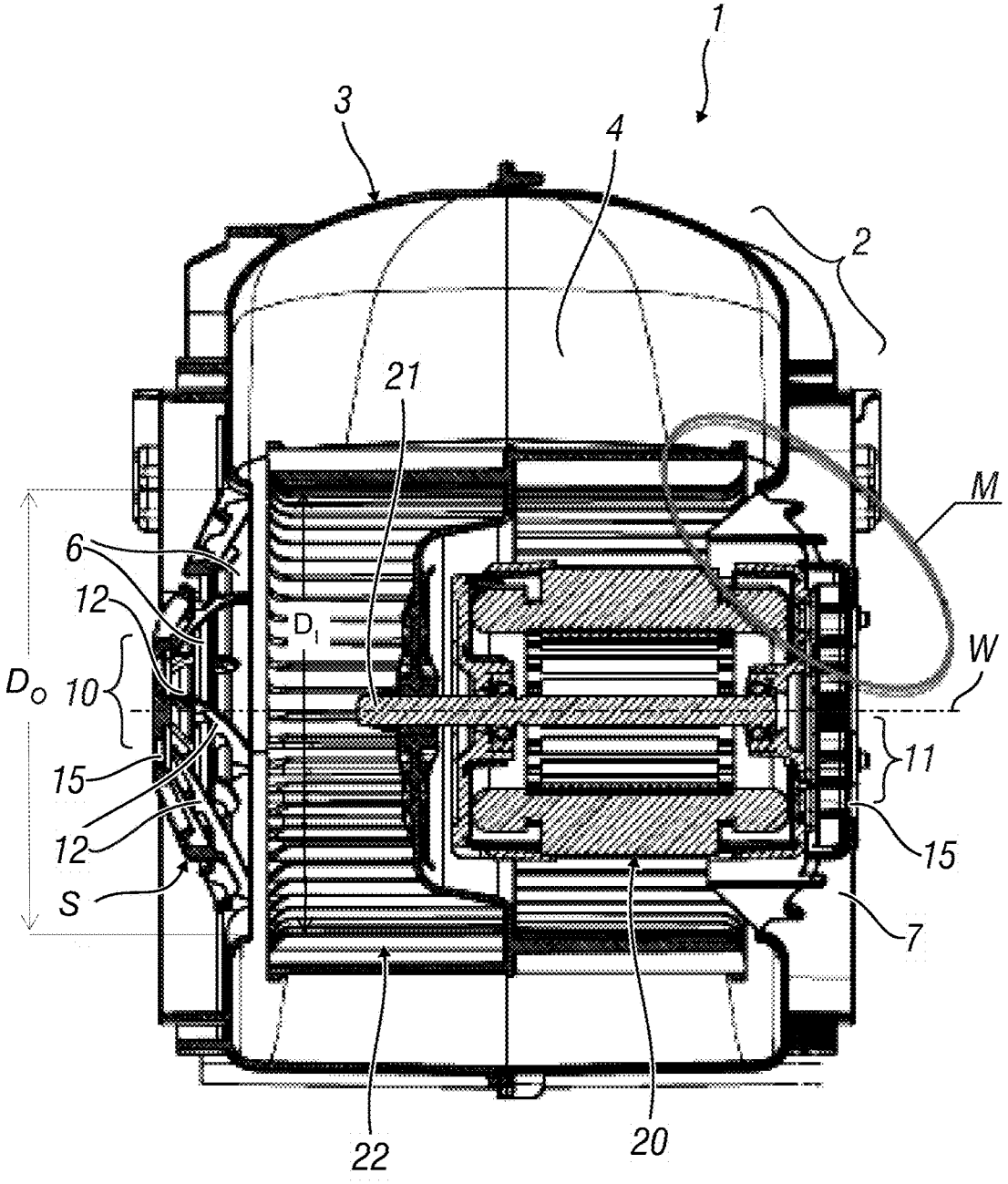
FIG. 11 shows a sectional view along line 11-11 of FIG. 5.
Figure 12:
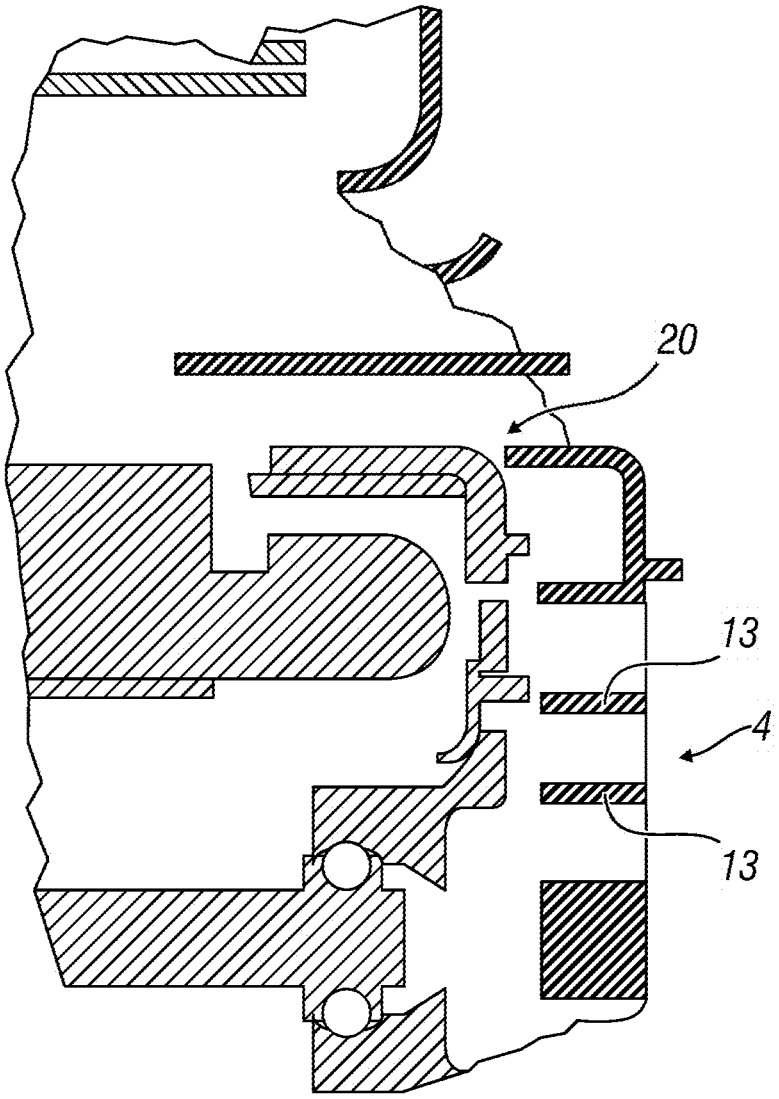
FIG. 12 shows a magnified view of the detail denoted M in FIG. 11.
Figure 13:
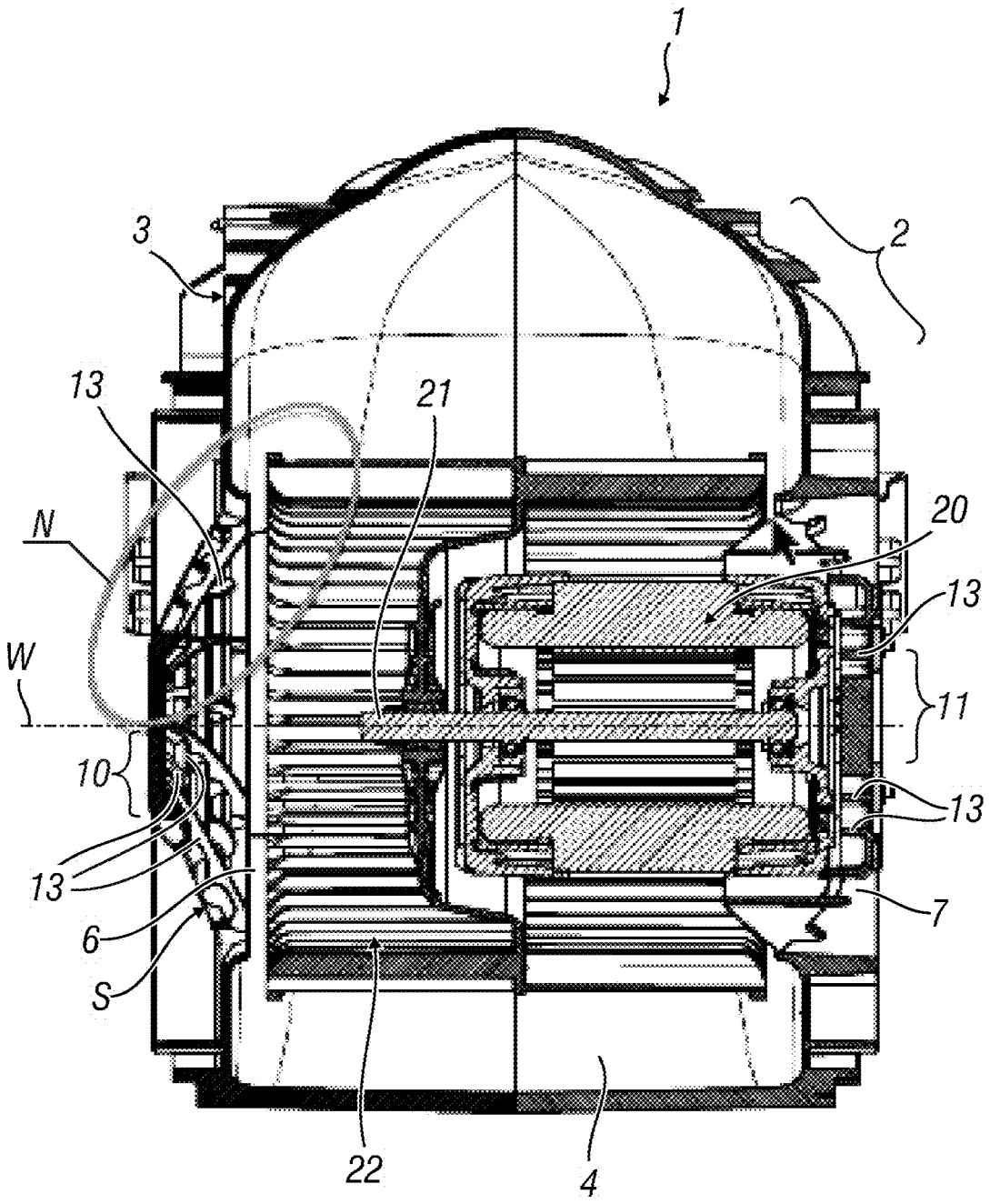
FIG. 13 shows a sectional view along line 13-13 of FIG. 5.
Figure 14:
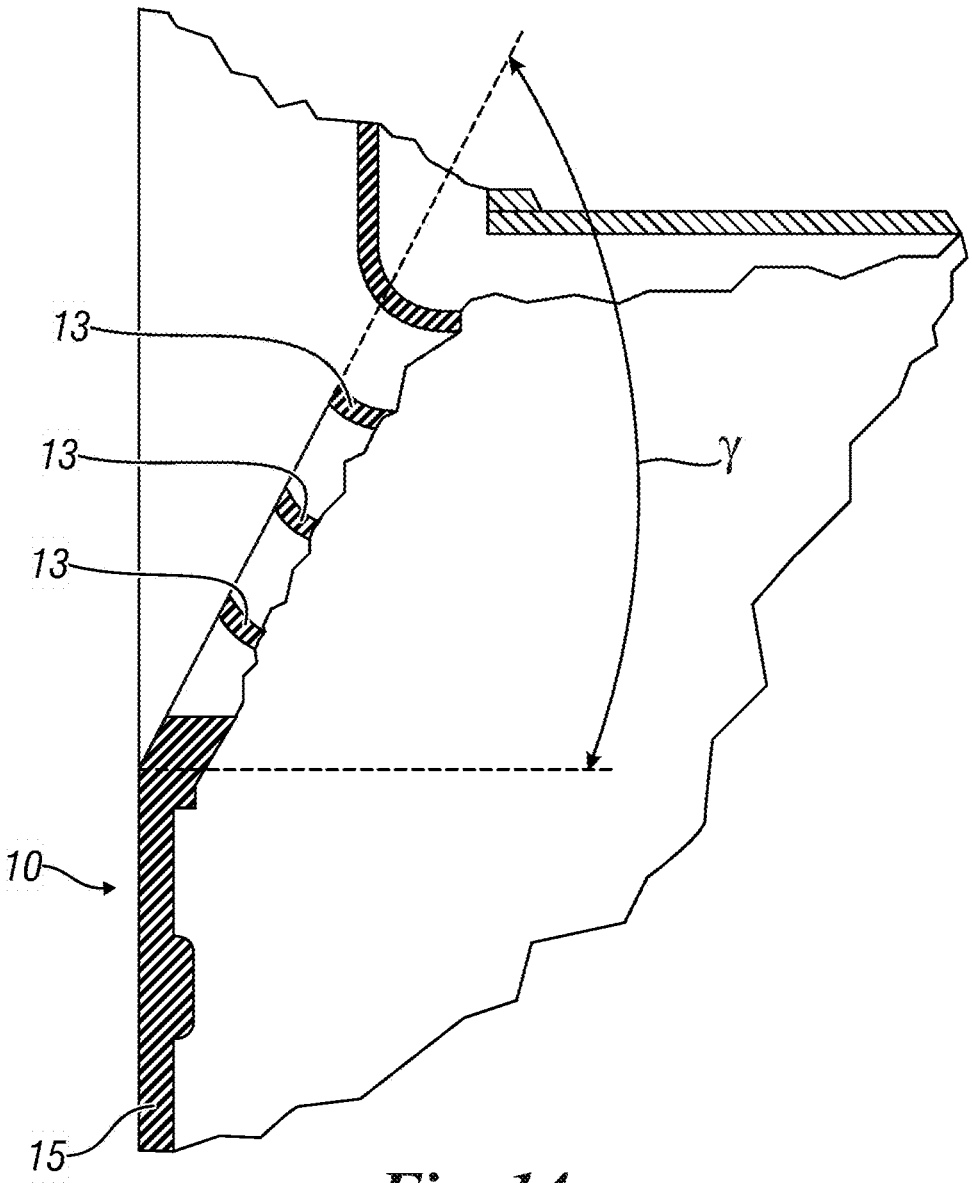
FIG. 14 shows a magnified view of the detail denoted N in FIG. 13.

In addition, the ribs 12 of the grille 10 facing the single impeller 22 are spiral in configuration, which contributes to creating optimum flow on intake of the vapours by the impeller. The ribs are located on a frustoconical surface S (see FIGS. 11 and 13) projecting out from the casing 2. For example, the angle of the truncated cone, denoted y in FIG. 14, is between 25 and 30°.

The particular configuration of the grille contributes to optimising fluid dynamics in the vapour flow and reduces losses in the latter, so improving the efficiency of the fan assembly 1.

A similar observation may be made with regard to the grille 11 located at the level of the inlet opening 9 towards which the electric motor 20 (which is contained in the impeller 22) also faces.

In this case, the grid 11 is flat, but still has the spiral ribs 13 like those 12 of the grille 10 in front of the (single) impeller. Said configuration also helps to reduce vapour intake losses and to increase the efficiency of the fan assembly 1.

Thanks to the invention, it has surprisingly been found that, by modifying immobile, structural components of the fan assembly 1, it is possible to achieve clear benefits with respect not only to the energy and fluid-dynamic performance of the fan assembly but also to the generation of noise during the use thereof.

The invention claimed is:

1. A fan assembly for an extractor hood to be used in a kitchen over a hob, said fan assembly comprising:

a body or casing having an internal cavity which is bounded by a wall of said casing;

an impeller and an electric motor contained in said casing, said impeller being located in the cavity and, with the wall of said cavity and starting from a blower cut-off part, defines a spiral duct for the vapours taken into said cavity, said spiral duct opening into a terminal outlet and the casing having side openings on opposite sides to allow entry of vapours at a level of the impeller, and a diameter of the side openings of the casing is equal to that of an inner diameter of the impeller;

starting from said blower cut-off part and moving along the spiral duct, the wall of the casing comprises a plurality of successive sections having radii or radial configurations which differ from one another, said successive sections define transverse portions of the wall of said casing, a first one of the successive sections together with an outlet section comprising the terminal outlet of the spiral duct, the plurality of said successive sections having side surfaces connected to transverse surfaces, said side surfaces having free edges defining, when assembled, a perimetral edge of the side openings of the casing, and corners of said plurality of successive sections are located between the side surfaces and the transverse surfaces, the corners having corresponding radii of curvature (A, B, C, D, E, F) in which:

A) the radius of curvature of the corner of the first successive section is between 1 and 5 mm, B) the radius of curvature of the corner of a second one of the successive sections is between 2 and 8 mm, C) the radius of curvature of the corner of a third one of the successive sections is between 3 and 12 mm, D) the radius of curvature of the corner of a fourth one of the successive sections is between 10 and 30 mm, E) the radius of curvature of the corner of a fifth one of the successive sections is between 20 and 40 mm, and F) the radius of curvature of the corner of a sixth one of the successive sections is between 90 and 120 mm.

2. The fan assembly according to claim 1, wherein at least some of said successive sections are parts of two half-shells which, when assembled along a plane which is perpendicular to a drive shaft of the electric motor, define the casing.

3. The fan assembly according to claim 2, wherein each of the half-shells has one said side opening of the casing.

4. The fan assembly according to claim 1, wherein the assembled successive sections defining the wall of the casing bound, with the impeller, the spiral duct which has a course mathematically defined by the formula:

$$r(\Psi)=r_1*(1+K\Psi)$$

in which:

r=a distance between a centre of the impeller and the wall of the casing as a function of an angle along the duct in the casing where a radius is calculated;

r_1=a minimum distance between the centre of the impeller and the wall of the casing;

K=a constant value defined during fan assembly design based on specific values associated with a distance between the centre of the impeller and the wall of the casing at specific angles; and Ψ=an arc unfolding value, in degrees.

5. The fan assembly according to claim 4, wherein the distance between the centre of the impeller and the wall of the casing is at a minimum at a level of a cut-off part of the fan assembly, one end of said cut-off part extending beyond a plane of symmetry of the impeller close to the terminal outlet of the spiral duct of the casing, a segment connecting said end with the centre of the impeller forming an angle with said plane of symmetry of between 3.3° and 5.0°, said cut-off part having an arcuate configuration with an inclined upper wall which forms an angle of between 45° and 70°.

6. The fan assembly according to claim 1, further comprising a grille having ribs following a spiral course at a level of each side opening of the casing.

7. The fan assembly according to claim 6, wherein the ribs of the grille located on the opening facing the impeller rest on a frustoconically shaped surface.

* * * * *